United States Patent [19]

Kumagai et al.

[11] Patent Number: 4,977,875

[45] Date of Patent: Dec. 18, 1990

[54] TWO-STROKE-CYCLE UNIFLOW SPARK-IGNITION ENGINE

[75] Inventors: Seiichiro Kumagai, Tokyo; Michikata Kono, Hachioji; Masakazu Okai, Kanagawa; Hisashi Inaga, Tokyo, all of Japan

[73] Assignee: Kioritz Corporation, Tokyo, Japan

[21] Appl. No.: 339,740

[22] Filed: Apr. 18, 1989

[30] Foreign Application Priority Data

May 25, 1988 [JP] Japan ..... 63-125865

[51] Int. Cl.[5] ..... F02B 3/00

[52] U.S. Cl. ..... 123/299; 123/65 VC; 123/73 C

[58] Field of Search ..... 123/65 BA, 65 VC, 73 C, 123/299, 300, 305, 73 PP, 65 A, 65 R

[56] References Cited

U.S. PATENT DOCUMENTS

| | | | |
|---|---|---|---|
| 2,188,368 | 1/1940 | McCarthy | 123/65 VC |
| 2,246,019 | 6/1941 | Steinlein | 123/73 C |
| 2,255,424 | 9/1941 | Jandasek | 123/65 VC |
| 2,640,422 | 6/1953 | Malin | 123/299 |
| 2,853,061 | 9/1958 | Elsbett | 123/65 BA |
| 2,887,993 | 5/1959 | Shallenberg | 123/65 BA |
| 4,069,794 | 1/1978 | Jordan | 123/193 P |
| 4,140,088 | 2/1979 | de Vulpillieres | 123/299 |
| 4,414,940 | 11/1983 | Loyd | 123/299 |
| 4,660,513 | 4/1987 | Figliuzzi | 123/65 A |
| 4,682,570 | 7/1987 | Velencei | 123/73 PP |
| 4,790,270 | 12/1988 | McKay et al. | 123/73 C |

FOREIGN PATENT DOCUMENTS

| | | | |
|---|---|---|---|
| 109806 | 2/1940 | Australia . | |
| 150050 | 2/1953 | Australia . | |
| 96732 | 12/1923 | Fed. Rep. of Germany | 123/65 VC |
| 833366 | 10/1938 | France | 123/65 VC |
| 0096125 | 6/1983 | Japan | 123/65 VC |
| 8707325 | 12/1987 | PCT Int'l Appl. | 123/65 VC |
| 375116 | 6/1932 | United Kingdom | 123/65 VC |
| 379561 | 9/1932 | United Kingdom | 123/65 VC |
| 422400 | 1/1935 | United Kingdom . | |
| 723972 | 2/1955 | United Kingdom . | |
| 778589 | 7/1957 | United Kingdom . | |
| 790508 | 2/1958 | United Kingdom . | |
| 2105787 | 3/1983 | United Kingdom . | |

*Primary Examiner*—David A. Okonsky
*Attorney, Agent, or Firm*—Browdy and Neimark

[57] ABSTRACT

A two-stroke-cycle uniflow spark-ignition engine. A fluid sucked and pressurized by a compressor driven by the engine is delivered to an annular scavenging chamber formed in a cylinder around the entire circumference thereof, so as to be accumulated therein. The fluid within the annular scavenging chamber is discharged therefrom, through a plurality of scavenging ports formed in the cylinder and capable of opening into a cylinder chamber toward the end of a descending stroke of a piston, and/or into a recess which is above the piston, the discharged fluid serving as a scavenging fluid that flows generating a swirling uniflow. A mixture compressed within the cylinder chamber during an ascending stroke of the piston is ignited by an ignition plug for combustion.

3 Claims, 4 Drawing Sheets

TWO-STROKE-CYCLE UNIFLOW SPARK-IGNITION ENGINE

BACKGROUND OF THE INVENTION

1.Field of the Invention

The present invention relates to a two-stroke-cycle uniflow spark-ignition engine wherein either a scavenging fluid solely comprising air pressurized by a compressor driven by the engine is supplied into the cylinder and a fuel or an air-fuel mixture is simultaneously injected and supplied into the cylinder, or a scavenging fluid comprising a mixture of air and fuel is supplied into the cylinder, the scavenging fluid so supplied is then compressed by the piston, spark-ignited, and undergoes combustion to generate power, and exhaust gas resulting from the combustion is expelled through the exhaust valve provided in the cylinder head.

2.Description of the Related Art

Conventional two-stroke-cycle spark-ignition engines are based on the so-called three-port type engine developed by Day, J., a British engineer, in 1891.In this two-stroke-cycle spark-ignition engine, the conversion of the energy provided by a fuel into useful power takes place as follows: An air-fuel mixture which is supplied from an inlet port of a cylinder is precompressed in a crank chamber, and the precompressed air-fuel mixture is introduced into the cylinder through a scavenging passage from a scavenging port which is opened to a cylinder wall surface against which a piston slides. The air-fuel mixture so supplied is further compressed by the piston in the cylinder. Upon ignition of this fuel-air mixture, it undergoes combustion and thereby generates power. Exhaust gas is expelled through an exhaust port provided in the wall surface of the cylinder against which the piston slides.

Suitable scavenging methods for such a conventional two-stroke-cycle spark-ignition engine include cross-flow scavenging in which a scavenging port and an exhaust port are disposed in the cylinder in opposed relation with each other, and in which a piston head is provided with a protrusion to prevent the scavenging fluid from directly flowing into the exhaust port; and loop scavenging in which a plurality of scavenging ports are disposed symmetrically with respect to the exhaust port. The engine performance has been improved in both of these scavenging systems so that less fuel is required to operate the engine for a given load. However, it seems that the possibility for additional research has reached its limit.

As regards combustion, with any of the above-described scavenging systems, the rate of dilution of scavenging air (an air-fuel mixture) with residual combustion gas is far higher than that obtained in a normal four-stroke-cycle spark-ignition engine. This deteriorates the ignitability of the air-fuel mixture charged in the cylinder and makes it impossible for a two-stroke-cycle spark-ignition engine to be operated with an air-fuel mixture as lean as that used in four-stroke-cycle spark-ignition engines. Thus, misfire readily occurs unless a particularly powerful spark is used for ignition. Finding a solution to this problem is difficult because it is associated with the two-stroke-cycle scavenging method employed.

Furthermore, the conventional two-stroke-cycle spark-ignition engine has essential disadvantages that it consumes a relatively large amount of lubricant, that the exhaust gas contains larger amounts of hydro-carbons and carbon monoxide due to the problems involving scavenging and combustion, and that the exhaust gas is smelly and accompanied by smother due to the fact that lubricant is readily mixed with the air fuel mixture in the cylinder.

Although the conventional two-stroke-cycle spark-ignition engine generally has a slightly better engine performance, is simple construction and small in size, and can be manufactured at a lower cost than a four-stroke-cycle spark-ignition engine of the same displacement, it suffers from the problems that it consumes larger amounts of fuel and lubricant, that the exhaust gas is a pollutant, and that it generates vibrations and noise due to its lack of stability and smoothness of running operation.

These factors limit the use of the existing two-stroke-cycle spark-ignition engine to special applications, including small portable industrial machines, small motor bicycles and motor boats, and excluding applications that require more power, such as automobiles, and those that require a low level of noise such as vehicles for use on public roads.

SUMMARY OF THE INVENTION

Accordingly, an object of the present invention is to provide a two-stroke-cycle uniflow spark-ignition engine in which the problems or drawbacks of the above-described conventional two-stroke-cycle spark-ignition engine are eliminated without losing the merits of the two-stroke-cycle spark-ignition engine.

A two-stroke-cycle uniflow spark-ignition engine according to the present invention comprises: a cylinder defining a cylinder chamber; a cylinder head provided at the top of the cylinder; a piston reciprocating within the cylinder chamber; an annular scavenging chamber formed in the cylinder around the entire circumference thereof; a fluid sucked and pressurized by a compressor driven by the engine being delivered to the annular scavenging chamber to be accumulated therein; a plurality of scavenging ports formed in the cylinder and capable of opening into the cylinder chamber toward the end of a descending stroke of the piston; the fluid within the annular scavenging chamber being discharged therefrom through the opened scavenging ports into a portion of the cylinder chamber which is above the piston; the discharged fluid serving as a scavenging fluid that flows generating a swirling uniflow; an ignition plug for igniting and causing combustion of a mixture compressed within the cylinder chamber during an ascending stroke of the piston; and an exhaust valve provided in the cylinder head and capable of opening toward the end of a descending stroke of the piston that is concurrent with explosion and expansion of the combustion gas, the opened exhaust valve allowing burned exhaust gas to be expelled.

With the above-specified arrangement, therefore, a fluid sucked and pressurized by a compressor driven by the engine is delivered to the annular scavenging chamber so as to be accumulated therein. The fluid within the annular scavenging chamber is discharged therefrom through a plurality of the scavenging ports into the cylinder chamber to serve as a scavenging fluid that flows in the form of a swirling uniflow. The fluid flowing in this way is compressed during an ascending stroke of the piston, and, upon ignition by the ignition plug, combustion takes place to generate power.

Thus, the engine of the present invention is capable of achieving an increase in the engine output with a reduced fuel consumption, a lower amount of combustible of lubricant, and remarkable improvement in the properties of the exhaust gas, as compared to the conventional two-stroke-cycle spark-ignition engine. Accordingly, the engine of the present invention is capable of serving as an engine with high level of reliability, which may be used as a novel prime mover with a broad range of possible applications including various industrial machines and various transportation machines.

According to one aspect of the present invention, the scavenging fluid which is discharged into the cylinder chamber through the scavenging ports after the fluid has been pressurized by the compressor and then delivered to the annular scavenging chamber comprises air. The engine is further comprised in a plurality of nozzles provided in the cylinder for injecting fuel into the cylinder chamber and capable of injecting fuel by solid injection or air injection, being provided in such a manner that a fuel injected therefrom self-collides at a point in the cylinder chamber.

According to another aspect of the present invention, the scavenging fluid comprises a mixture of air and fuel.

DESCRIPTION OF THE PREFERRED EMBODIMENTS

Figure 1:
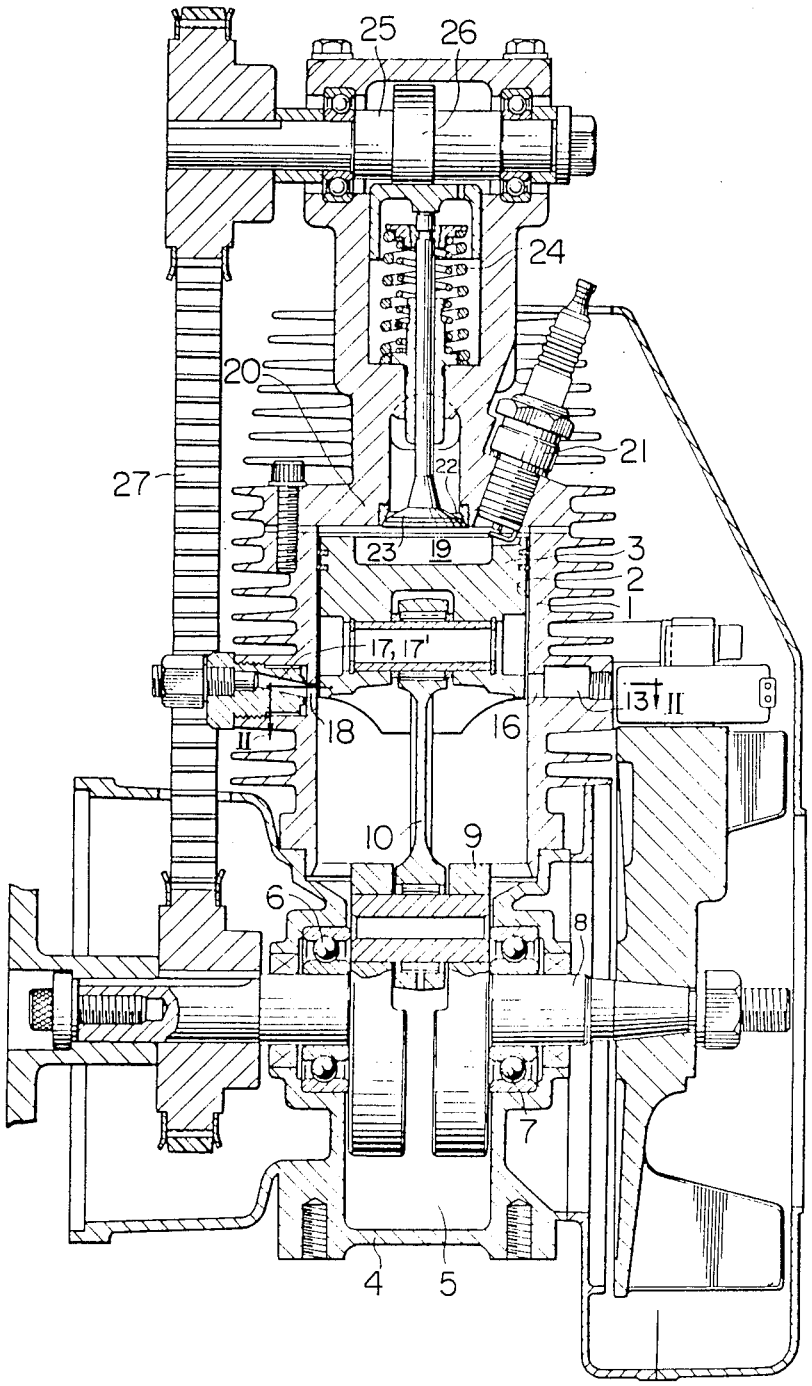
FIG. 1 is a vertical cross-sectional view of a two-stroke-cycle uniflow spark-ignition engine, showing a first embodiment of the present invention.
Figure 2:
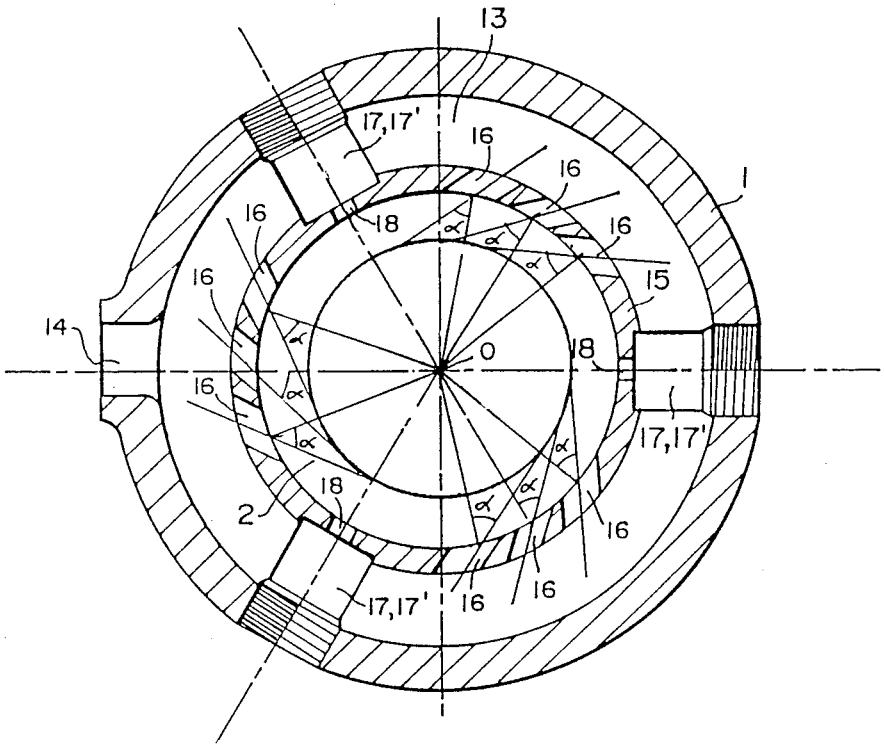
FIG. 2 is a section taken along the line II—II of FIG. 1.
Figure 3:
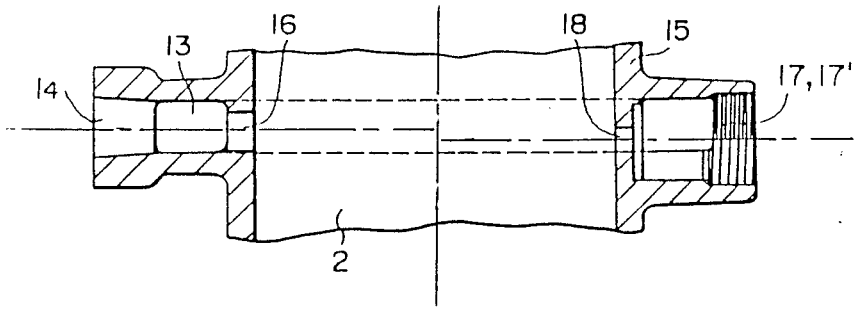
FIG. 3 is a vertical cross-sectional view of a cylinder portion of FIG. 2.
Figure 4:
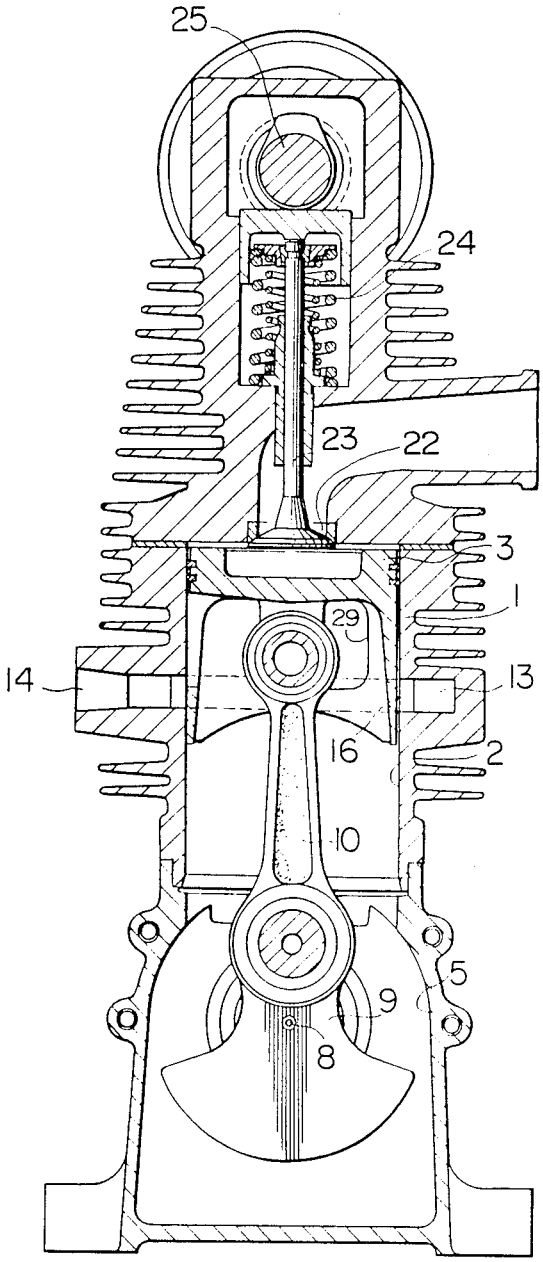
FIG. 4 is a vertical cross-sectional view of the two-stroke-cycle uniflow spark-ignition engine taken along the vertical plane perpendicular to the section of FIG. 1.

A first embodiment of the present invention will be described below with reference to FIGS. 1 to 4.

The two-stroke-cycle uniflow spark-ignition engine includes a cylinder 1, a piston 3 reciprocating within a cylinder chamber 2 of the cylinder 1, and a crankcase 4 provided below the cylinder 1. The lower end portion of the cylinder chamber 2 is made to communicate with the upper end portion of the crankcase 4. A crank shaft 8 is rotatibly supported by the crankcase 4 through bearings 6 and 7. The crank shaft 8 is coupled to the piston 3 through a connecting rod 10 at a crank 9.

The crankcase 4 defines a crank chamber 5 having an internal volume sufficient to allow the rotation of the crank 9 and the movement of the connecting rod 10 as well as to act as a storage for lubricant. The interior of the crank chamber 5 communicates with the exterior of the engine through a breather (not shown).

The cylinder 1 has an annular scavenging chamber 13 formed therein around the entire circumference thereof. The annular scavenging chamber 13 communicates through a scavenging fluid inlet port 14 opening into a portion of the annular scavenging chamber 13 with the discharge port of a compressor (not shown) driven by the engine. A fluid, such as air, pressurized by the compressor is introduced, as a scavenging fluid, into the annular scavenging chamber 13 to be accumulated therein.

The annular scavenging chamber 13 communicates with the interior of the cylinder chamber 2 through a plurality of scavenging ports 16 (this embodiment has nine of them) which may be formed in an inner wall portion 15 (see FIG. 2) of the cylinder 1. The scavenging ports 16 are formed along a plane perpendicular to the central axis 0 of the cylinder 1 (see FIG. 3). Alternatively, they may be formed along a slightly conical surface with respect to the central axis 0. Further, each of the scavenging ports 16 is formed so that the center of the end portion thereof is inclined in a direction at about 45 degrees with respect to the radial line that passes through the central axis 0 of the cylinder 1 (see FIG. 2). This arrangement allows the scavenging fluid to be discharged into the cylinder chamber 2 from the annular scavenging chamber 13 through the individual scavenging ports 16 in the form of a swirling uniflow that rotates horizontally in the cylinder chamber 2. Alternatively, the scavenging ports 16 may be arranged so that they are divided into some groups and so that these scavenging ports 16 are inclined at some different angles so as to generate a desired flow of scavenging fluid that swirls within the cylinder chamber 2.

The cylinder chamber 2 is provided with a plurality of (three in this embodiment) solid injection type of fuel injection nozzles 17 or air injection type of fuel injection nozzles 17' which are arranged along the circumference of the cylinder chamber 2 at substantially equal angular intervals. Each of solid injection type of fuel injection nozzles 17 or air injection type of fuel injection nozzles 17' has its nozzle tip portion 18 directed from the inner wall portion 15 of the cylinder 1 to the interior of the cylinder chamber 2. The nozzles 17 or 17' are so provided that they are each capable of injecting fuel for solid injection or air injection toward the vicinity of the central axis of the cylinder chamber 2. With this arrangement, therefore, a fuel by solid injection of fuel or air injection of fuel injected from the nozzle tip portions 18 of the individual nozzles 17 or 17' into the cylinder chamber 2 self-collides at a point in the vicinity of the central axis of the cylinder chamber 2. This results in the formation of fine particles of fuel which are then mixed with the swirling flow of the scavenging fluid, e.g. air, discharged through the scavenging ports 16 into the cylinder chamber 2.

If air injection type of fuel injection nozzles 17' are provided and if these are nozzles of atomizing type which employ compressed air, since they have to be supplied with compressed air, the air injection type of fuel injection nozzles 17' may be so arranged as to communicate with the discharge side of the compressor and be supplied with part of high-pressure air compressed. Alternatively, the arrangement of the air injection type of fuel injection nozzles 17' may be such that they are connected to an air pump driven by the engine so as to be supplied with high-pressure air from the pump.

If solid injection type of fuel injection nozzles 17 are provided, these may be of pressure atomizing type.

Also if solid injection type of fuel injection nozzles 17 are provided, a fuel which may be directly injected into the cylinder chamber 2 to be used therein is not limited to a liquid fuel, but instead may be a gaseous fuel such as city gas, natural gas, LPG, etc.

The head portion of the piston 3 is provided with a recess 19 for forming the space in which the mixture undergoes combustion.

An alternative arrangement may be adopted in which the scavenging ports 16 are used to discharge an air-fuel mixture into the cylinder chamber 2.

An ignition plug 21 is provided in a cylinder head 20, i.e., at the top portion of the cylinder 1. The ignition plug 21 is connected to an ignition system (not shown), and operates when the piston 3 reaches the vicinity of the top dead center thereof so as to ignite the compressed air-fuel mixture within the cylinder chamber 2 for combustion.

The top portion of the cylinder 1 is provided with an exhaust port 22, which is opened and closed by an exhaust valve 23. The exhaust valve 23 may be of poppet type which is generally employed in the four-stroke-cycle spark-ignition engine. It is brought into contact with a cam surface 26 of a camshaft 25 by means of a spring 24. The camshaft 25 is coupled to the crank shaft 8 through a toothed timing belt 27 so that it is driven at the same rotational speed as that of the crank shaft 8, and this allows the exhaust valve 23 to be opened and closed at predetermined time intervals so as to discharge the burned exhaust gas within the cylinder chamber 2 to the outside thereof. The exhaust valve 23 is operated in the same manner as that employed in the OHV (over head valve) or OHC (over head cam shaft) type for the conventional four-stroke-cycle spark-ignition engine. If the exhaust valve 23 is the one which is provided on the side of the cylinder, it is operated in the same manner as that employed in the SV (side valve) type.

As regards lubrication, a lubricant may be supplied in the same manner as that employed in a normal four-stroke-cycle spark-ignition engine. That is, either a lubricant may be directly supplied to the movable portions of the engine by means of a pump device driven by the crank shaft 8, or an oil dipper provided on the connecting rod 10 may be used to splash lubricant stored in the crank chamber 5 directly onto the movable portions.

Figure 5:
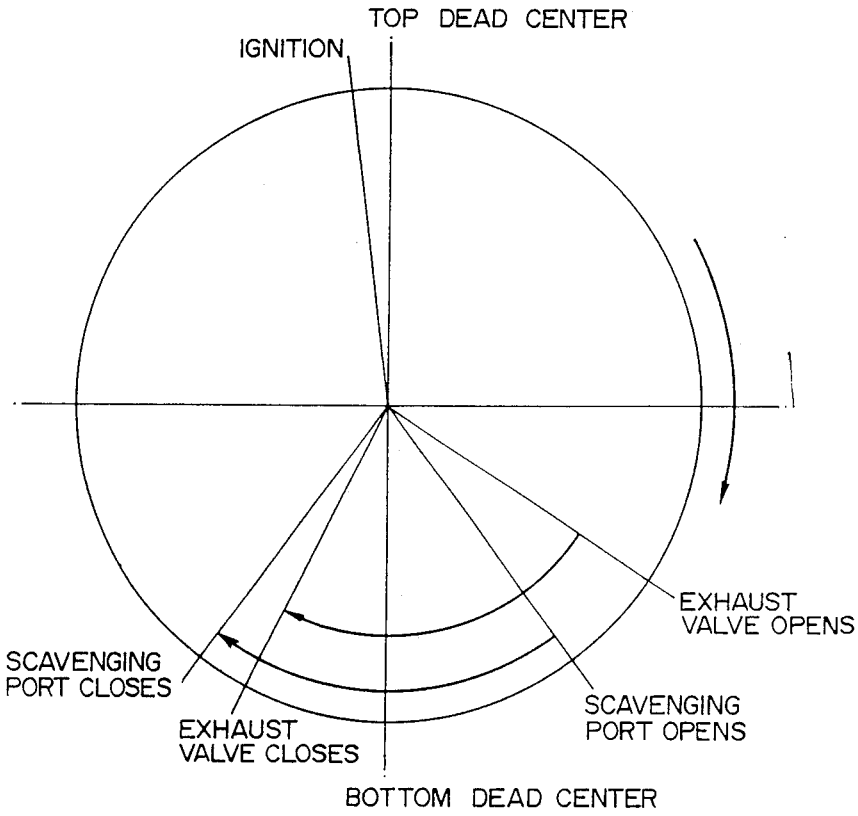
FIG. 5 is a valve timing diagram of an engine according to the present invention, which is illustrated using the crank angle.

FIG. 5 is a valve timing diagram of a single cylinder two-stroke-cycle uniflow spark-ignition engine which is adopted in the above-described embodiment of the present invention, which is illustrated using the crank angle.

The reciprocating spark ignition engine according to the present invention may also be constructed as a multi cylinder engine which is generally carried out as the conventional two-stroke-cycle spark-ignition engines. Further, as regards cooling, both of the air cooling system and the liquid cooling system can be adopted in the two-stroke-cycle spark-ignition engine according to the present invention. Furthermore, the present invention can be applied to engines having displacements which are normal among the existing four-stroke-cycle spark-ignition engines.

The suction port of the above-described compressor may be connected to the discharge port of a supercharger driven by an exhaust gas turbine, so as to affect supercharging.

What is claimed is:

1. A two-stroke-cycle uniflow spark-ignition engine comprising a cylinder defining a cylinder chamber;

a cylinder head provided at the top of said cylinder;

at least three nozzles located in a plane perpendicular to the axis of said cylinder and aimed to inject fuel therefrom to have the fuel from all three nozzles self collide at a point in said cylinder chamber;

a piston located in said cylinder chamber for reciprocating within said cylinder chamber;

an annular scavenging chamber formed in said cylinder around the entire circumference of said cylinder chamber;

a fluid sucked and pressurized by a compressor driven by the engine delivered to said annular scavenging chamber to be accumulated therein;

a plurality of scavenging ports formed in said cylinder and capable of opening into said cylinder chamber toward the end of a descending stroke of said piston, said scavenging ports being in substantially the same said plane containing said nozzles;

said fluid within said annular scavenging chamber being discharged therefrom through said opened scavenging ports into a portion of said cylinder chamber which is above said piston, in a swirling uniflow stream;

said discharged fluid serving as a scavenging fluid that flows in said swirling uniflow stream;

an ignition plug for igniting and causing combustion of a mixture compressed within said cylinder chamber during an ascending stroke of said piston;

and an exhaust valve provided in said cylinder head and capable of opening toward the end of a descending stroke of said piston that is concurrent with explosion and expansion of combustion gas, the opened exhaust valve allowing burned exhaust gas to be expelled;

said piston having a recess therein forming a space in which said compressed mixture from said nozzles and said scavenging ports undergoes combustion.

2. A two-stroke-cycle uniflow spark-ignition engine according to claim 1 wherein location of said nozzles and said scavenging ports in said cylinder chamber with said piston in ascended position applies a stratified combustion of said mixture.

3. A two-stroke-cycle uniflow spark-ignition engine comprising a cylinder defining a cylinder chamber;

a cylinder head provided at the top of said cylinder;

a piston reciprocating within said cylinder chamber;

an annular scavenging chamber formed in said cylinder around the entire circumference thereof;

a fluid sucked and pressurized by a compressor driven by said engine being delivered to said annular scavenging chamber to be accumulated therein;

a plurality of scavenging ports formed in said cylinder and capable of opening into said cylinder chamber toward the end of a descending stroke of said piston;

the fluid within said annular scavenging chamber being discharged therefrom through the opened scavenging ports into a portion of said cylinder chamber which is above said piston, the discharged fluid serving as a scavenging fluid that flows generating a swirling uniflow stream;

an ignition plug for igniting and causing combustion of a mixture compressed within said cylinder chamber during an ascending stroke of said piston;

and an exhaust valve provided in said cylinder head and capable of opening toward the end of a descending stroke of said piston that is concurrent with explosion and expansion of the combustion gas, the opened exhaust valve allowing burned exhaust gas to be expelled;

said scavenging fluid which is discharged into said cylinder chamber through said scavenging ports after said fluid has been pressurized by said compressor and then delivered to said annular scavenging chamber comprising air;

said engine further comprising a plurality of nozzles provided in said cylinder for injecting fuel into said cylinder chamber and capable of injecting a fuel for solid injection or air injection;

said plurality of nozzles for injecting fuel into said cylinder chamber including at least three nozzles located in a plane perpendicular to the axis of said cylinder and aimed to inject fuel therefrom to have the fuel from all three nozzles self collide at a point in said cylinder chamber;

said scavenging ports being in substantially the same said plane containing said nozzles.

* * * * *